US006263046B1

(12) United States Patent
Rogers

(10) Patent No.: US 6,263,046 B1
(45) Date of Patent: Jul. 17, 2001

(54) HEAT PIPE ASSISTED COOLING OF X-RAY WINDOWS IN X-RAY TUBES

(75) Inventor: Carey S. Rogers, Waukesha, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/366,998

(22) Filed: Aug. 4, 1999

(51) Int. Cl.[7] ..... H01J 35/10
(52) U.S. Cl. ..... 378/141; 378/140; 378/200
(58) Field of Search ..... 378/140, 141, 378/142, 199, 200

(56) References Cited

U.S. PATENT DOCUMENTS

| | | | | |
|---|---|---|---|---|
| 3,719,847 | | 3/1973 | Webster | 378/144 |
| 4,146,815 | | 3/1979 | Childeric | 378/144 |
| 4,165,472 | | 8/1979 | Wittry | 378/127 |
| 4,601,331 | * | 7/1986 | Kessler, Jr. et al. | 165/104.33 |
| 5,420,906 | * | 5/1995 | Smit et al. | 378/141 |
| 5,486,703 | * | 1/1996 | Lovin et al. | 250/492.3 |
| 5,511,104 | * | 4/1996 | Mueller et al. | 378/125 |
| 5,742,662 | | 4/1998 | Kuhn et al. | 378/138 |
| 5,828,727 | * | 10/1998 | Schild | 378/140 |
| 5,987,097 | * | 11/1999 | Salasoo | 378/141 |
| 6,005,918 | * | 12/1999 | Harris et al. | 378/140 |

* cited by examiner

*Primary Examiner*—Robert H. Kim
*Assistant Examiner*—Allen C. Ho
(74) *Attorney, Agent, or Firm*—Foley & Lardner; Christian G. Cabou

(57) ABSTRACT

An x-ray tube for emitting x-rays through an x-ray transmissive window is disclosed herein. The x-ray tube includes a casing, an x-ray tube insert which generates x-rays, an x-ray transmissive window disposed in the x-ray tube insert, and at least one heat pipe thermally coupled to the x-ray transmissive window. The x-ray transmissive window provides an area through which the x-rays pass. The heat pipe transfers thermal energy away from the x-ray transmissive window, providing intense, localized cooling of the x-ray window.

12 Claims, 4 Drawing Sheets

HEAT PIPE ASSISTED COOLING OF X-RAY WINDOWS IN X-RAY TUBES

BACKGROUND OF THE INVENTION

The present invention relates generally to imaging systems. More particularly, the present invention relates to the cooling of x-ray windows in x-ray tubes.

Electron beam generating devices, such as x-ray tubes and electron beam welders, operate in a high temperature environment. In an x-ray tube, for example, the primary electron beam generated by the cathode deposits a very large heat load in the anode target to the extent that the target glows red-hot in operation. Typically, less than 1% of the primary electron beam energy is converted into x-rays, while the balance is converted to thermal energy. This thermal energy from the hot target is radiated to other components within the vacuum vessel of the x-ray tube, and is removed from the vacuum vessel by a cooling fluid circulating over the exterior surface of the vacuum vessel. Additionally, some of the electrons back scatter from the target and impinge on other components within the vacuum vessel, causing additional heating of the x-ray tube. As a result of the high temperatures caused by this thermal energy, the x-ray tube components are subject to high thermal stresses which are problematic in the operation and reliability of the x-ray tube.

Typically, an x-ray beam generating device, referred to as an x-ray tube, comprises opposed electrodes enclosed within a cylindrical vacuum vessel. The vacuum vessel is typically fabricated from glass or metal, such as stainless steel, copper or a copper alloy. As mentioned above, the electrodes comprise the cathode assembly that is positioned at some distance from the target track of the rotating, disc-shaped anode assembly. Alternatively, such as in industrial applications, the anode may be stationary.

The target track, or impact zone, of the anode is generally fabricated from a refractory metal with a high atomic number, such as tungsten or tungsten alloy. A typical voltage difference of 60 kV to 140 kV is maintained between the cathode and anode assemblies to accelerate the electrons. The hot cathode filament emits thermal electrons that are accelerated across the potential difference, impacting the target zone of the anode at high velocity. A small fraction of the kinetic energy of the electrons is converted to high energy electromagnetic radiation, or x-rays, while the balance is contained in back scattered electrons or converted directly into heat within the anode. The x-rays are emitted in all directions, emanating from the focal spot, and may be directed out of the vacuum vessel.

In an x-ray tube having a metal vacuum vessel, for example, an x-ray transmissive window is fabricated into the metal vacuum vessel to allow the x-ray beam to exit at a desired location. After exiting the vacuum vessel, the x-rays are directed to penetrate an object, such as human anatomical parts for medical examination and diagnostic procedures. The x-rays transmitted through the object are intercepted by a detector and an image is formed of the internal anatomy. Further, industrial x-ray tubes may be used, for example, to inspect metal parts for cracks or to inspect the contents of luggage at airports.

Since the production of x-rays in an x-ray tube is by its nature a very inefficient process, the components in x-ray generating devices operate at elevated temperatures. For example, the temperature of the anode focal spot can run as high as about 2700° C., while the temperature in the other parts of the anode may range up to about 1800° C. Additionally, other components of the x-ray tube must be able to withstand the high temperature exhaust processing of the x-ray tube, at temperatures that may approach approximately 450° C. for a relatively long duration.

To cool the x-ray tube, the thermal energy generated during tube operation must be radiated from the anode to the vacuum vessel and be removed by a cooling fluid. The vacuum vessel is typically enclosed in a casing filled with circulating, cooling fluid, such as dielectric oil. The casing supports and protects the x-ray tube and provides for attachment to a computed tomography (CT) system gantry or other structure. Also, the casing is lined with lead to provide stray radiation shielding.

The cooling fluid often performs two duties: cooling the vacuum vessel, and providing high voltage insulation between the anode and cathode connections in the bipolar configuration. The performance of the cooling fluid may be degraded, however, by excessively high temperatures that cause the fluid to boil at the interface between the fluid and the vacuum vessel and/or the transmissive window. The boiling fluid produces bubbles within the fluid that may allow high voltage arcing across the fluid, thus degrading the insulating ability of the fluid. Further, the bubbles may lead to image artifacts, resulting in low quality images. Thus, the current method of relying on the cooling fluid to transfer heat out of the x-ray tube may not be sufficient for new, higher power x-ray tubes.

Similarly, excessive temperatures can decrease the life of the transmissive window, as well as other x-ray tube components. Due to its close proximity to the focal spot, the x-ray transmissive window is subject to very high heat loads resulting from thermal radiation and back scattered electrons. These high thermal loads on the transmissive window necessitate careful design to insure that the window remains intact over the life of the x-ray tube, especially in regard to vacuum integrity.

The transmissive window is an important hermetic seal for the x-ray tube. The high heat loads cause very large cyclic stresses in the transmissive window and can lead to premature failure of the window and its hermetic seal. Further, as mentioned above, direct contact with the cooling fluid can cause the fluid to boil as it flows over the window. Also, direct contact with a window that is too hot can cause degraded hydrocarbons from the fluid to become deposited on the window surface, thereby reducing image quality. Thus, the conventional method of cooling the transmissive window by simple immersion in a flow of oil may not be satisfactory.

The greatest localized heating of the x-ray window is due to back scattered electrons from the target impacting the window. The conventional method of providing cooling to the x-ray window is by a flow of the dielectric oil that is pumped through the casing of the x-ray tube assembly. As x-ray tubes become more powerful, this method of cooling has become inadequate. New techniques in x-ray computed tomography, such as, fast helical scanning, require vastly more powerful x-ray tubes. One proposed approach includes a device to electromagnetically deflect the back scattered electrons away from the window. This approach can be very difficult to implement and control and also causes greater heat loads on other components within the x-ray tube vacuum vessel.

As mentioned above, x-ray transmissive windows in metal-framed x-ray tubes can receive enormous heat fluxes due to thermal radiation and back scattered electrons from the anode. In metal-framed x-ray tubes, the transmissive window is typically made of a low atomic number material, such as, beryllium, aluminum, or titanium. Due to its close proximity to the x-ray focal spot, the x-ray window is subject to very high thermal loads and stress. The window joint integrity is, therefore, the weakest link in the sustainable hermeticity of the vacuum enclosure. Consequently, it is vital to provide adequate cooling to the x-ray window to ensure its structural and functional integrity over the life of the x-ray tube.

The material that forms the window (e.g., beryllium) is typically joined to the metal vacuum enclosure by brazing, soldering, welding, or some combination. In a typical application, beryllium is brazed into a copper carrier which is itself brazed into the steel vacuum vessel of an x-ray tube insert. The copper acts as a conduction heat sink for the beryllium and matches the thermal diffusivity and expansion characteristics.

Generally, the vacuum vessel and window are cooled by a bulk flow of dielectric oil, or similar coolant. However, as new, more powerful, x-ray tubes are developed, this simple style of cooling will prove to be inadequate. As such, novel techniques are required to ensure the survivability of the window.

Thus, there is a need for an apparatus which provides adequate cooling for x-ray transmissive windows such as those found in metal-framed x-ray tubes. Further, there is a need for an apparatus which provides heat dissipation at the junction of the x-ray window braze joint.

BRIEF SUMMARY OF THE INVENTION

One embodiment of the invention relates to an x-ray tube for emitting x-rays through an x-ray transmissive window. The x-ray tube includes a casing, an x-ray tube insert which generates x-rays, an x-ray transmissive window disposed in the x-ray tube insert, and a heat pipe assembly thermally coupled to the x-ray transmissive window. The x-ray transmissive window provides an area through which the x-rays pass. The heat pipe transfers thermal energy away from the x-ray transmissive window.

Another embodiment of the invention relates to an x-ray tube for emitting x-rays with increased performance by effective heat dissipation. The x-ray tube includes an x-ray transmissive window and means for conducting thermal energy away from the x-ray transmissive window.

Another embodiment of the invention relates to a method for dissipating heat from an x-ray transmissive window on an x-ray generating device. The method includes providing a heat pipe thermally coupled to the x-ray transmissive window, providing x-rays through the x-ray transmissive window, and transferring thermal energy away from the x-ray transmissive window through the heat pipe.

Another embodiment of the invention relates to a method of assembling an x-ray tube having a casing, an x-ray tube insert, an x-ray transmissive window, and at least one heat pipe. The method includes locating an x-ray tube casing, orienting an x-ray tube insert within the casing, and fastening at least one heat pipe to the x-ray transmissive window.

Other principle features and advantages of the present invention will become apparent to those skilled in the art upon review of the following drawings, the detailed description, and the appended claims.

BRIEF DESCRIPTION OF THE DRAWINGS

The invention will become more fully understood from the following detailed description, taken in conjunction with the accompanying drawings, wherein like reference numerals denote like elements, in which.

DETAILED DESCRIPTION OF THE INVENTION

Figure 1:
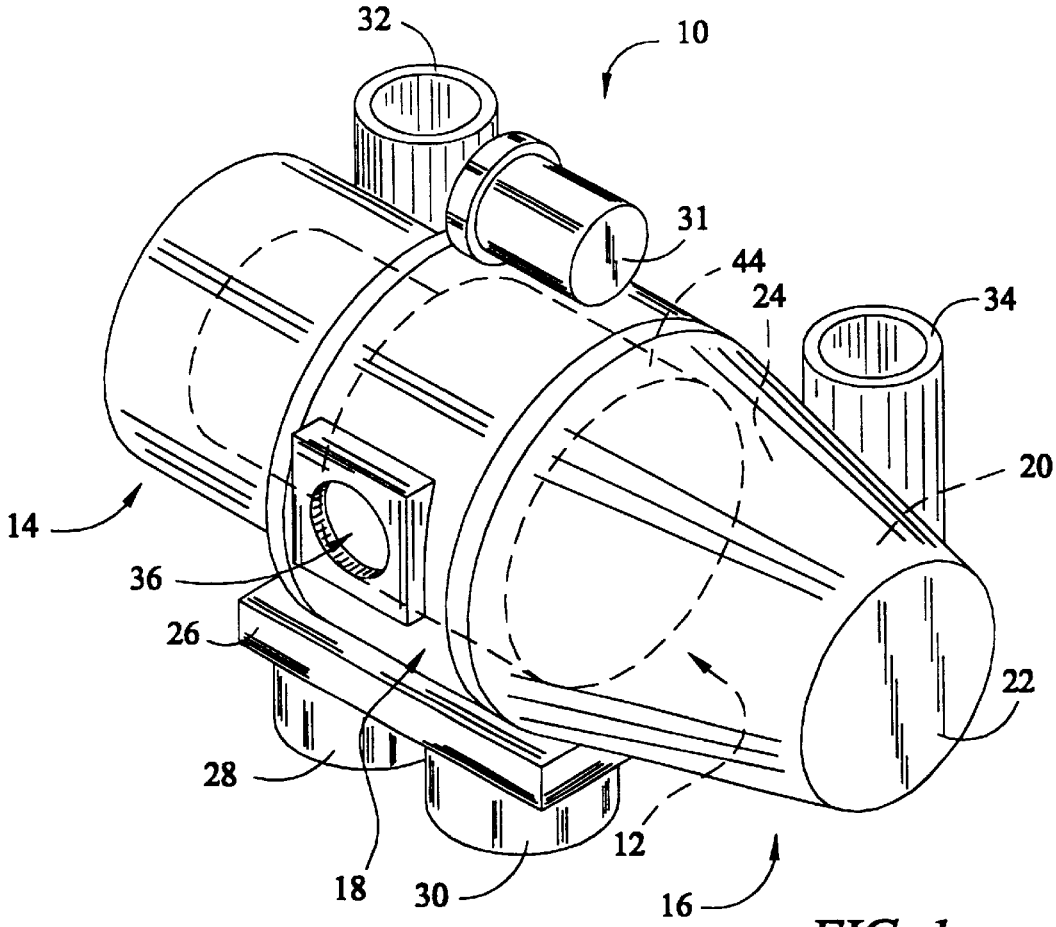
FIG. 1 is a perspective view of a casing enclosing an x-ray tube insert in accordance with a preferred embodiment of the present invention.

FIG. 1 illustrates an x-ray tube assembly unit 10 for an x-ray generating device or x-ray tube insert 12. X-ray tube assembly unit 10 includes an anode end 14, cathode end 16, and a center section 18 positioned between anode end 14 and cathode end 16. X-ray tube insert 12 is enclosed in a fluid-filled chamber 20 within a casing 22.

Fluid-filled chamber 20 generally is filled with a fluid 24, such as, dielectric oil, which circulates throughout casing 22 to cool x-ray tube insert 12. Fluid 24 within fluid-filled chamber 20 is cooled by a radiator 26 positioned to one side of center section 18. Fluid 24 is moved throughout fluid-filled chamber 20 and radiator 26 by a pump 31. Preferably, a pair of fans 28 and 30 are coupled to radiator 26 for providing cooling air flow over radiator 26 as hot fluid flows through it.

Electrical connections to x-ray tube insert 12 are provided through an anode receptacle 32 and a cathode receptacle 34. X-rays are emitted from x-ray generating device 12 through a casing window 36 in casing 22 at one side of center section 18.

Figure 2:
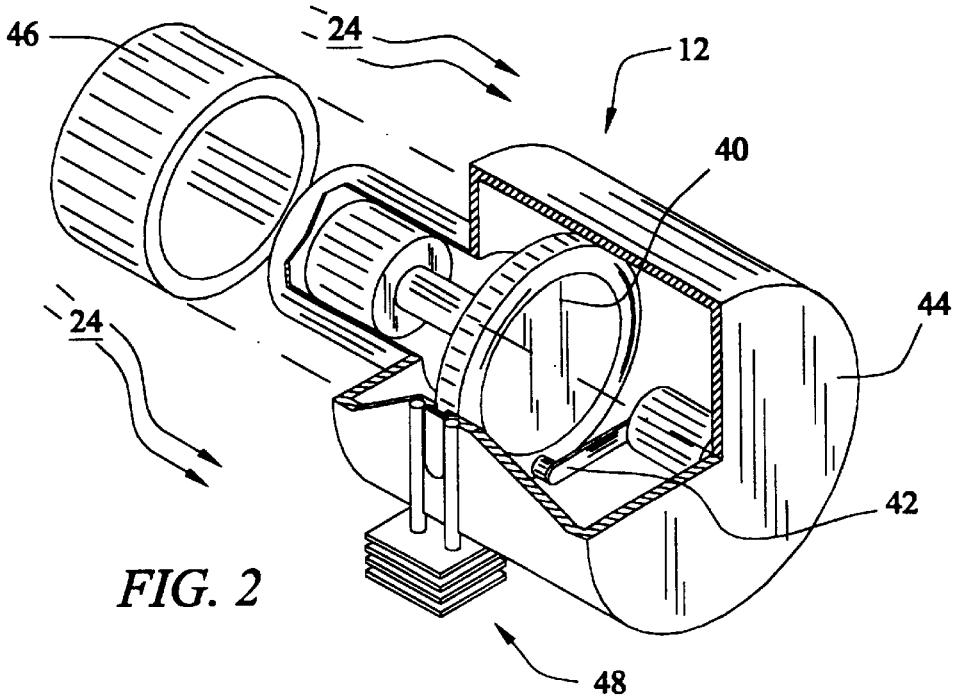
FIG. 2 is a sectional perspective view with the stator exploded to reveal a portion of an anode assembly of the x-ray tube insert of FIG. 1.

As shown in FIG. 2, x-ray tube insert 12 includes a target anode assembly 40 and a cathode assembly 42 disposed in a vacuum within a vessel 44. A stator 46 is positioned over vessel 44 adjacent to target anode assembly 40. Upon the energization of the electrical circuit connecting target anode assembly 40 and cathode assembly 42, which produces a potential difference of, e.g., 60 kV to 140 kV, electrons are directed from cathode assembly 42 to target anode assembly 40. The electrons strike target anode assembly 40 and produce high frequency electromagnetic waves, or x-rays, and residual thermal energy. The residual energy is absorbed by the components within x-ray tube insert 12 as heat. In one embodiment, target anode assembly 40 includes a rotating target which distributes the area which is impacted by the electrons from the cathode assembly 42.

Figure 3:
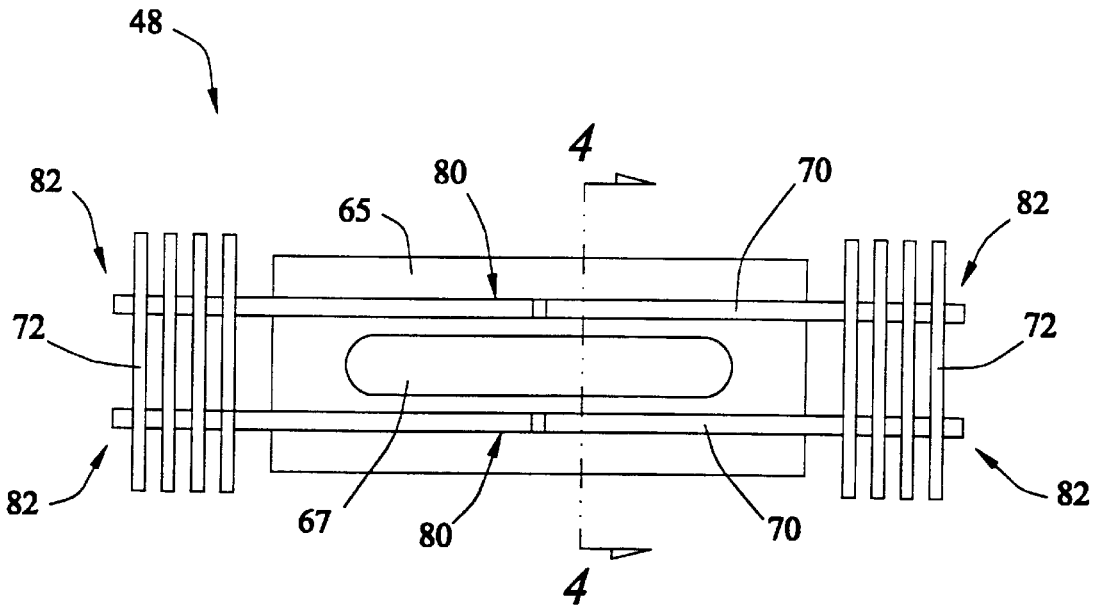
FIG. 3 is a front view of an x-ray window in the x-ray tube of FIG. 1 showing the relation between the heat pipe assembly and the x-ray window.
Figure 4:
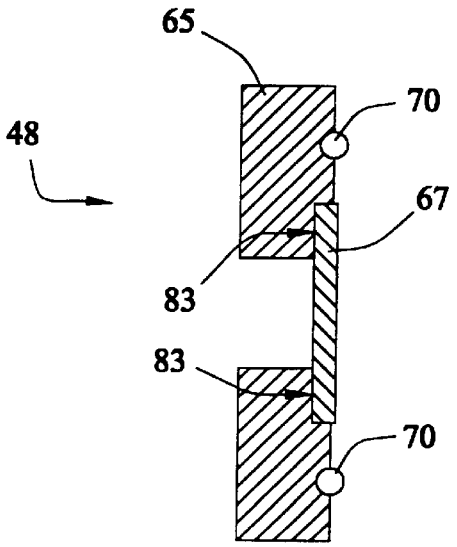
FIG. 4 is a side cross-sectional view of the x-ray window of FIG. 3 taken along line 4—4.

X-ray tube insert 12 includes an x-ray transmissive insert window 48, which is transparent to x-rays while maintaining a hermetic seal for tube insert 12. FIGS. 3 and 4 illustrate a front view and a side cross-sectional view of x-ray transmissive insert window 48, respectively. X-ray transmissive insert window 48 includes a substrate 65, a x-ray transmissive window pane 67, heat pipes 70, and fin structures 72.

Substrate 65 is made from a highly conductive material, such as, copper. X-ray transmissive window pane 67 is made of an x-ray transmissive material, such as, beryllium, aluminum, or titanium. X-ray transmissive window pane 67 and substrate 65 are coupled together by a braze joint 83.

Heat pipes 70 are located in close proximity to, and are thermally coupled to, the braze joint. During operation of x-ray tube insert 12, x-ray transmissive insert window 48 reaches very high temperatures, such as 300° C. Such high temperatures can cause a failure in the braze joint connecting substrate 65 and x-ray transmissive window pane 67. Advantageously, heat pipes 70 greatly reduce the temperature at the braze joints by rapidly removing heat from braze joint 83.

Each heat pipe 70 is an evacuated, sealed metal pipe partially filled with a working fluid. In general, heat pipe 70 transfers heat away from a source of heat such as window pane 67. Fluid 24 has the capability of transferring heat away from the extended fin surfaces 72.

Figure 5:
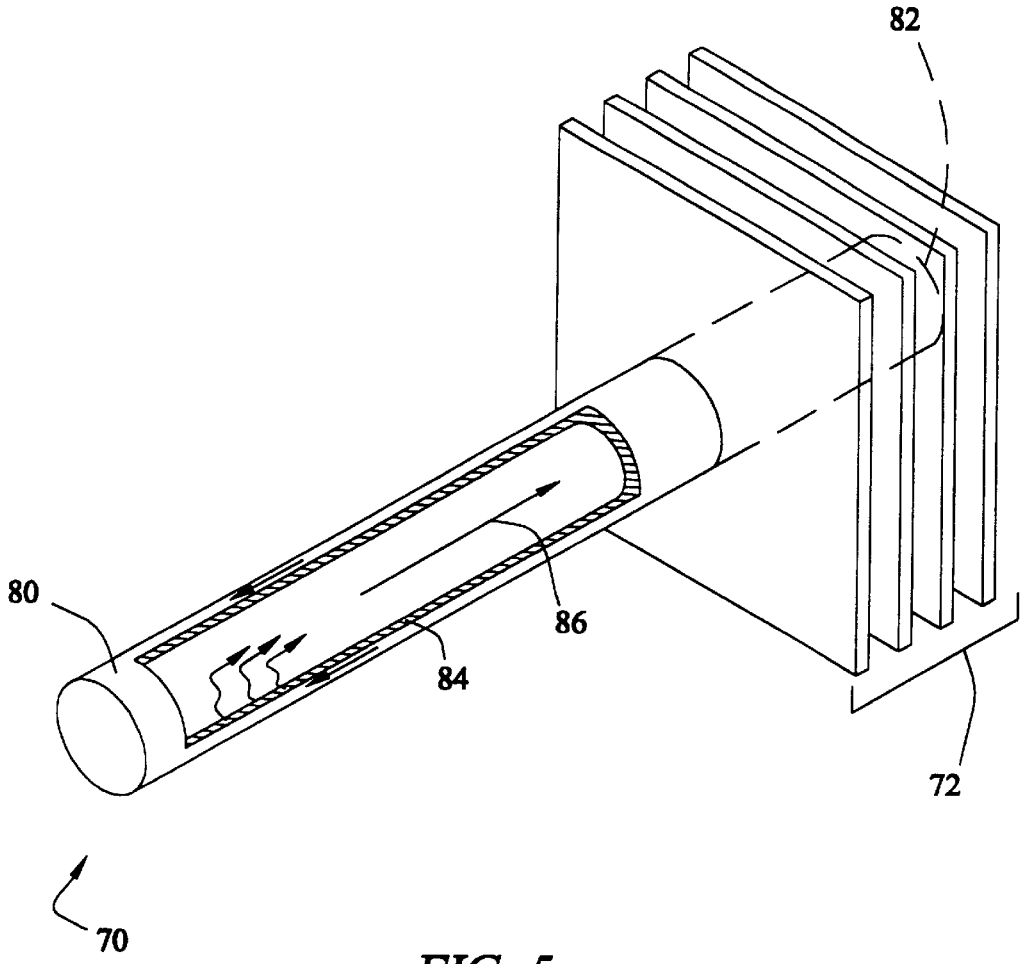
FIG. 5 is a perspective view with partial cross section of a heat pipe included in the x-ray tube of FIG. 1.

As shown in FIG. 5, the internal walls of heat pipe 70 contain a capillary wick structure 84 extending from an evaporator end or section 80 to a condenser end or section 82. Capillary wick structure 84 allows heat pipe 70 to operate against gravity by transferring the liquid form of the working fluid to the opposite end of heat pipe 70 where it is vaporized by heat. In the exemplary embodiment (FIG. 3), evaporator end or section 80 is located near the middle of window pane 67, where the thermal energy is the greatest, and condenser end or section 82 is located within casing 22 in the flow of coolant oil 24.

Heat pipes (as shown in FIG. 5) have found wide application in space-based applications, electronic cooling, and other high-heat-flux applications. For example, heat pipes can be found in satellites, laptop computers, and solar power generators. A wide variety of working fluids have been used with heat pipes, including, nitrogen, ammonia, alcohol, water, sodium, and lithium. Heat pipes have the ability to dissipate very high heat fluxes and heat loads through small cross sectional areas. Heat pipes have a very large effective thermal conductivity and can move a large amount of heat from source to sink. A typical heat pipe can have an effective thermal conductivity more than two orders of magnitude larger than a similar solid copper conductor. The allowable heat flux at the evaporator has been measured as high as 1,270 $W/mm^2$ with tungsten/lithium heat pipes. Advantageously, heat pipes are totally passive and are used to transfer heat from a heat source to a heat sink with minimal temperature gradients, or to isothermalized surfaces.

In the exemplary embodiment, heat pipe 70 is made of copper and includes water as a working fluid. Alternatively, heat pipe 70 is made of monel or some other material. Heat pipes can be manufactured using a wide range of materials and working fluids spanning the temperature range from cryogenic to molten lithium. Heat pipes suitable for this application are commercially available.

In operation, heat from x-ray transmissive window pane 67 enters evaporator end 80 of each heat pipe 70 where the working fluid is evaporated, creating a pressure gradient in the pipe. The pressure gradient forces the resulting vapor through the hollow core of the heat pipe 70 to the cooler condenser end 82 where the vapor condenses and releases its latent heat of vaporization to the heat sink. The liquid is then wicked back by capillary forces through capillary wick structure 84 to evaporator end 80 in a continuous cycle. For a well designed heat pipe, effective thermal conductivities can range from 10 to 10,000 times the effective thermal conductivity of copper depending on the length of the heat pipe.

In one embodiment, fin structures 72 at condenser ends 82, transfer the heat to cooling fluid 24 circulating in casing 22. For an x-ray tube beryllium window, it is desirable to limit the peak temperature to no more than about 300° C.

Advantageously, heat pipes 70 provide intense, localized cooling all around the window periphery. Further, heat pipes 70 are very small in relation to their heat carrying capacity. Additionally, heat pipes 70 are passive devices requiring no pumps or other moving parts, are completely quiet in operation, and have essentially unlimited life. Moreover, heat pipes 70 work against gravity because of the internal capillary action. Heat pipes 70 are inexpensive and are made of materials of construction which are compatible with existing x-ray tube configurations.

In alternative embodiments, performance of heat pipes 70 can be enhanced by applying an acceleration force to aide in moving the liquid back to the evaporator end. Such an acceleration force can be achieved on an x-ray tube used for computed tomography (CT) applications where the tube rotates around a patient.

Figure 6:
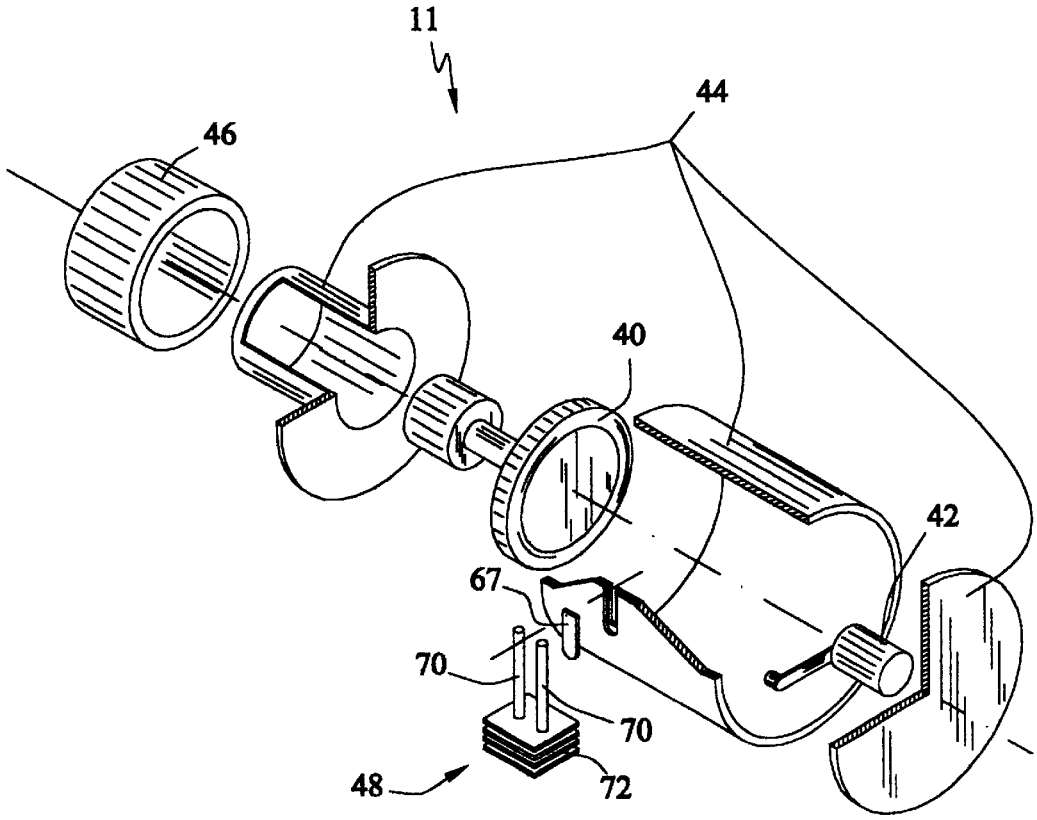
FIG. 6 is an exploded view of the x-ray tube insert of FIG. 1.

FIG. 6 illustrates a portion 11 of unassembled x-ray tube assembly unit 10. Portion 11 includes target anode assembly 40, cathode assembly 42, vacuum vessel 44, stator 46, and x-ray transmissive insert window 48. X-ray transmissive insert window 48 includes x-ray transmissive window pane 67, heat pipes 70, and fin surfaces 72. The assembly of x-ray tube assembly unit 10 includes locating casing 22, orienting x-ray tube insert 12 within the casing, and fastening at least one heat pipe 70 to x-ray transmissive window 48. X-ray tube assembly unit 10 can be repaired or reconstructed by the assembling of portion 11.

While the embodiments illustrated in the FIGURES and described above are presently preferred, it should be understood that these embodiments are offered by way of example only. Other embodiments may include other numbers, configurations or locations of heat pipes 70. The invention is not limited to a particular embodiment, but extends to various modifications, combinations, and permutations that nevertheless fall within the scope and spirit of the appended claims.

What is claimed is:

1. An x-ray tube for emitting x-rays through an x-ray transmissive window, the x-ray tube comprising:

a casing;

an x-ray tube insert which generates x-rays, the x-ray tube insert being located within the casing;

an x-ray transmissive window disposed in the x-ray tube insert to provide an area through which the x-rays pass; and at least one heat pipe thermally coupled to the x-ray transmissive window to transfer thermal energy away from the x-ray transmissive window.

2. The x-ray tube of claim 1, wherein the at least one heat pipe comprises an evacuated sealed metal pipe partially filled with a fluid.

3. The x-ray tube of claim 2, wherein the at least one heat pipe includes, an evaporator section and a condenser section, the evaporator section located near the x-ray transmissive window and the condenser section located distal to the x-ray transmissive window.

4. The x-ray tube of claim 3, wherein the at least one heat pipe further comprises means for applying an acceleration force to aide in moving the fluid back to the evaporator section of the heat pipe.

5. The x-ray tube of claim 2, wherein the at least one heat pipe includes internal walls having a capillary wick structure, the capillary wick structure providing for the transfer of fluid from one end of the at least one heat pipe to another end irregardless of gravity.

6. The x-ray tube of claim 2, wherein the fluid partially filling the evacuated sealed metal pipe is water.

7. The x-ray tube of claim 1, wherein the at least one heat pipe comprises a portion of solid pipe made of a heat conducting material.

8. The x-ray tube of claim 1, further comprising a plurality of fin structures mounted perpendicularly on the ends of the at least one heat pipe.

9. The x-ray tube of claim 1, wherein the x-ray transmissive window is made of beryllium.

10. A method for dissipating heat from an x-ray transmissive window on an x-ray generating device, the method comprising:

providing a heat pipe thermally coupled to the x-ray transmissive window;

providing x-rays through the x-ray transmissive window; and transferring thermal energy away from the x-ray transmissive window through the heat pipe, wherein the heat pipe comprises an evacuated sealed metal pipe partially filled with fluid and an evaporator end and a condenser end, and the step of transferring thermal energy away from the x-ray transmissive window comprises vaporizing the fluid at the evaporator end and liquifying the vaporized fluid at the condenser end, wherein the step of providing a heat pipe comprises providing a fin structure at the condenser end of the heat pipe, further comprising applying an acceleration force to aide in moving the fluid back to the evaporator section of the heat pipe.

11. A method of assembling an x-ray tube having a casing; an x-ray tube insert; an x-ray transmissive window; and at least one heat pipe, the method comprising:

locating an x-ray tube casing;

orienting an x-ray tube insert within the casing, the x-ray tube insert including an x-ray transmissive window through which x-rays pass; and fastening at least one heat pipe to the x-ray transmissive window.

12. The method of claim 11, including the steps of:

disposing the x-ray tube in packaging suitable for shipping; and shipping the packaged x-ray tube to a predetermined location.

* * * * *